US006739626B2

(12) United States Patent
Mori et al.

(10) Patent No.: US 6,739,626 B2
(45) **Date of Patent: *May 25, 2004**

(54) SPIRAL COIL AND BOOKBINDING DEVICE AND BOOKBINDING METHOD USING THE SAME

(75) Inventors: Makoto Mori, Katsushika-ku (JP); Fumio Shimizu, Katsushika-ku (JP)

(73) Assignee: Carl Manufacturing Co., Ltd., Tokyo (JP)

( * ) Notice: Subject to any disclaimer, the term of this patent is extended or adjusted under 35 U.S.C. 154(b) by 30 days.

This patent is subject to a terminal disclaimer.

(21) Appl. No.: 10/189,600

(22) Filed: Jul. 8, 2002

(65) Prior Publication Data

US 2004/0004353 A1 Jan. 8, 2004

(51) Int. Cl.[7] ..... B42D 1/00

(52) U.S. Cl. ..... 281/28; 140/92.3; 281/15.1; 281/27.1; 281/51; 402/8; 402/57; 402/73; 412/9; 412/33

(58) Field of Search ..... 281/15.1, 27.1, 281/27.2, 27.3, 28, 29, 51; 412/9, 33, 38, 39, 40; 402/8, 57, 70, 73, 80 P, 500, 502; 24/67 R; 140/92.3, 92.9

(56) References Cited

U.S. PATENT DOCUMENTS 2,638,609 A * 5/1953 Penner ..... 140/92.3
2,808,079 A * 10/1957 Tauber ..... 140/92.3
4,378,822 A * 4/1983 Morris ..... 140/92.3
5,417,508 A * 5/1995 Friedman ..... 402/19
5,584,632 A * 12/1996 Stiles et al. ..... 412/39
5,695,308 A * 12/1997 Hastings et al. ..... 412/39
5,785,479 A * 7/1998 Battisti et al. ..... 412/39
5,890,862 A * 4/1999 Spiel et al. ..... 412/40
5,931,623 A * 8/1999 Hastings et al. ..... 412/39
5,934,340 A * 8/1999 Anthony et al. ..... 140/92.94
6,640,837 B2 * 11/2003 Mori et al. ..... 140/92.3
2002/0090280 A1 * 7/2002 Spiel et al. ..... 412/40
2002/0129865 A1 * 9/2002 Mori et al. ..... 140/92.9
2002/0190451 A1 * 12/2002 Sancaktar et al. ..... 267/166

FOREIGN PATENT DOCUMENTS

JP 7-150314 * 6/1995

* cited by examiner

*Primary Examiner*—Monica S. Carter
(74) *Attorney, Agent, or Firm*—Oliff & Berridge, PLC

(57) ABSTRACT

A spiral coil is used when stacking a plurality of sheets each having a plurality of holes punched at a constant pitch, and binding the sheets by inserting the spiral coil therethrough. The spiral coil has a different pitch from that between the holes of the sheets. The spiral coil may be densely wound or have a different pitch from that of the sheets. A bookbinding device is prepared for inserting the spiral coil through the holes in the sheets. The bookbinding device has the same pitch as that between the holes, and has an engaging portion at an end thereof for engagement with the spiral coil. The bookbinding device is inserted through the holes such that the spiral coil follows it and is plastically deformed, thereby binding the sheet. The spiral coil after the plastic deformation is held at a pitch after the deformation.

6 Claims, 6 Drawing Sheets

SPIRAL COIL AND BOOKBINDING DEVICE AND BOOKBINDING METHOD USING THE SAME

BACKGROUND OF THE INVENTION

1. Field of the Invention

The present invention relates to a spiral coil for simplified bookbinding and a bookbinding device and method.

2. Description of the Related Art

According to one of known bookbinding techniques, a plurality of sheets is bound to one book by punching a plurality of holes in each sheet at a certain spacing and inserting a spiral coil through the holes, the spiral coil being wound at a constant pitch. Major advantages of that bookbinding technique are as follows: First, the bound book can be opened at 360 degrees. Secondary, high durability is ensured by using a coil made of metal or plastic. Another major advantage is that the production cost can be held relatively low.

However, conventional bookbinding techniques have a problem in that sheets and spiral coils have different pitches for bookbinding using a constant-pitch spiral coil, which is not standardized. More specifically, there are various pitches, resulting in inconvenience of erroneously using a spiral coil with a 6-mm pitch for a sheet having holes at a 5-mm spacing. Furthermore, the 6-mm-pitch spiral coil that is erroneously selected is not recoiled to an appropriate 5-mm pitch, which frequently occurs for personal consumers having no special equipment or dedicated machine.

In general, after the spiral coil has been inserted through the holes of the sheet, the spiral coil is bent at the ends for terminal treatment. In this case, it is well known that conventional art terminal treatment has the following drawbacks.

(1) It is difficult to reuse the spiral coil because of the bent ends. It is because it is generally difficult to restore the bent material made of metal or plastic into an original shape.

(2) It is difficult to take the bound sheets in and out again because the spiral coil is bent to be secured at a fixed position, thus making it difficult to change the order of the bound sheets.

(3) A dedicated device and labor are generally required to bend the spiral coil at the ends.

In other words, the conventional art bookbinding operation using the spiral coil has problems in that the sheets and the spiral coils vary in pitch and the reuse thereof is difficult.

SUMMARY OF THE INVENTION

The present invention has been made in consideration of the above problems; accordingly, it is an object of the present invention to provide a spiral coil and a bookbinding device using the spiral coil, which is easy to use with a simple structure and is able to perform bookbinding using a spiral coil that is coiled at a different pitch from the spacing between a plurality of holes punched in sheets. Another object of the present invention is to provide a new bookbinding method for integrally binding a plurality of sheets using the spiral coil and the bookbinding device.

In order to achieve the above objects, according to a first aspect of the present invention, there is provided a spiral coil used when stacking a plurality of sheets each having a plurality of holes punched at a constant pitch, and binding the plurality of sheets together by inserting the spiral coil through each of the holes, wherein the spiral coil is plastically deformed to have a different pitch from that between the holes in an unused state, and to have the same pitch as that between the holes during use.

With such a configuration, a plurality of sheets can be bound by the plastic deformation of the spiral coil irrespective of difference between the spacing between the holes punched in the sheets and the pitch of the spiral coil.

According to the present invention, preferably, the spiral coil is a variable-pitch spiral coil in an unused state.

With such a configuration, a plurality of sheets can be bound using the spiral coil wound at a variable pitch, such as a densely spiraled coil having high portability, a spiral coil wound at a different pitch, and a spiral coil used in different fields.

According to a second aspect of the present invention, there is provided a bookbinding device used when stacking a plurality of sheets each having a plurality of holes punched at a constant pitch, and binding the plurality of sheets together by inserting the spiral coil according to the first aspect of the invention through each hole, wherein the bookbinding device has a spiral shape wound at the same pitch as that between the plurality of holes and has an engaging portion formed in at least one end thereof for engaging with an end of the spiral coil.

With such a configuration, a bookbinding device can be provided to an individual consumer for binding a plurality of sheets by inserting a compact and easy-to-use spiral coil therethrough without the need for a large dedicated bookbinding device or a special work.

According to the present invention, preferably, the engaging portion has a shape different from the end of the spiral coil, and the end of the spiral coil is inserted into the engaging portion for engaging with each other.

With such a configuration, the spiral coil and the bookbinding device can easily be brought into engagement with each other only on the basis of the outer shapes without the need for special operation.

According to a third aspect of the present invention, a plurality of sheets each having a plurality of holes punched at a constant pitch is stacked and bound into one book using the spiral coil according to the first aspect of the invention and the bookbinding device according to the second aspect of the invention.

With such a configuration, there is provided a bookbinding method for binding a plurality of sheets into one book by inserting the spiral coil therethrough with an exceedingly simplified device without the need for a well-known electric or large bookbinding device.

The simplified bookbinding device using the spiral coil according to the present invention is in principle configured as described above. The spiral coil is preferably made of metal, such as iron. The plastic deformation is performed only by a simple operation at room temperature and normal pressure. One major feature is that since the bookbinding device and the spiral coil differ in diameter and pitch at the engaging portion of the bookbinding device, both are brought into frictional engagement with each other within the elastic limit. Furthermore, a storage case may be provided for enclosing the plurality of spiral coils or the bookbinding device according to the present invention.

DESCRIPTION OF THE PREFERRED EMBODIMENT

A preferred embodiment of the present invention will be described hereinbelow with reference to the attached drawings.

Figure 7A:
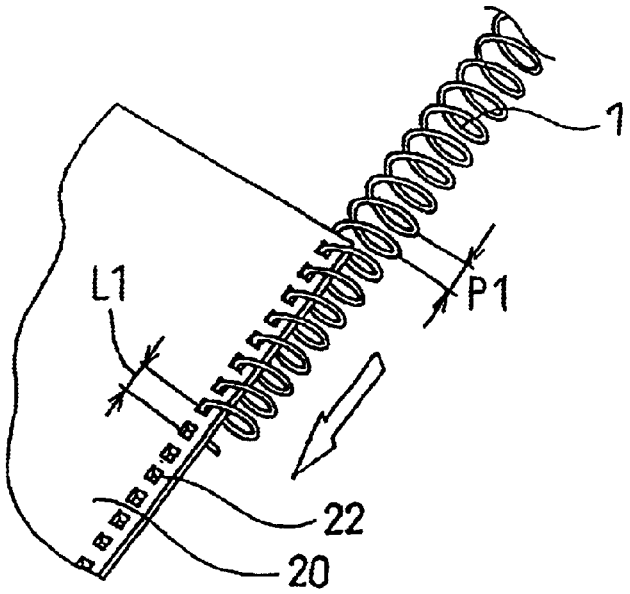
Fig. 7A Prior Art
FIGS. 7A to 7C show bookbinding operation using an equal-pitch spiral coil according to a conventional art, at three angles.
Figure 7B:
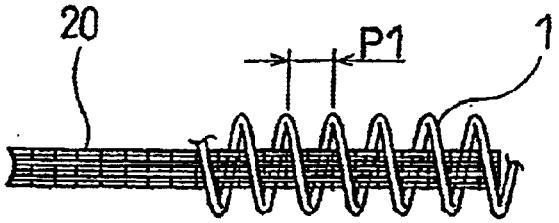
Fig. 7B Prior Art
Figure 7C:
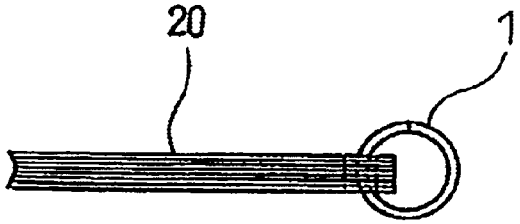
Fig. 7C Prior Art

According to a conventional-art binding operation, in order to bind a plurality of sheets 20 into one book, a spiral coil 1 with a constant pitch is inserted through a series of holes 22 punched in the side of the sheets 20. FIGS. 7A to 7C show the operation for binding the plurality of sheets 20 into one book using the spiral coil 1 according to the conventional art, at three angles, in a perspective view 7A, a side view 7B, and a plan view 7C. The spiral coil 1 is made of metal or plastic. The pitch P1 is the same as the centerline spacing L1 between the holes of the sheet 20. More specifically, assuming that the centerline spacing L1 (see FIG. 7A) between continuous holes 22 is, for example, a 6-mm pitch, the spiral coil 1 (see FIG. 7A) is also 6 mm in pitch. Thus, since the centerline spacing L1 between the holes 22 and the pitch P1 of the spiral coil 1 are the same, bookbinding operation can smoothly be performed. On the other hand, when the centerline spacing L1 between the holes 22 and the pitch P1 of the spiral coil 1 are different from each other, binding is generally difficult to perform according to the conventional art.

Practically, the centerline spacing L1 between the holes 22 punched in the sheets 20 are not always the same, and there are a large number of products corresponding to various pitches. Typically, many pitches lie within the range of 5 to 6 mm; however, standardization is not yet achieved because of the difference of markets between countries and so on. This poses problems of erroneously using the spiral coil 1 wound at a 5-mm pitch for the sheets 20 having the plurality of holes 22 punched at a 6-mm pitch. The present invention allows easy bookbinding of the plurality of sheets 20 having the plurality of holes 22 with a 6-mm pitch using the spiral coil 1 wound at a 5-mm pitch.

Figure 1:
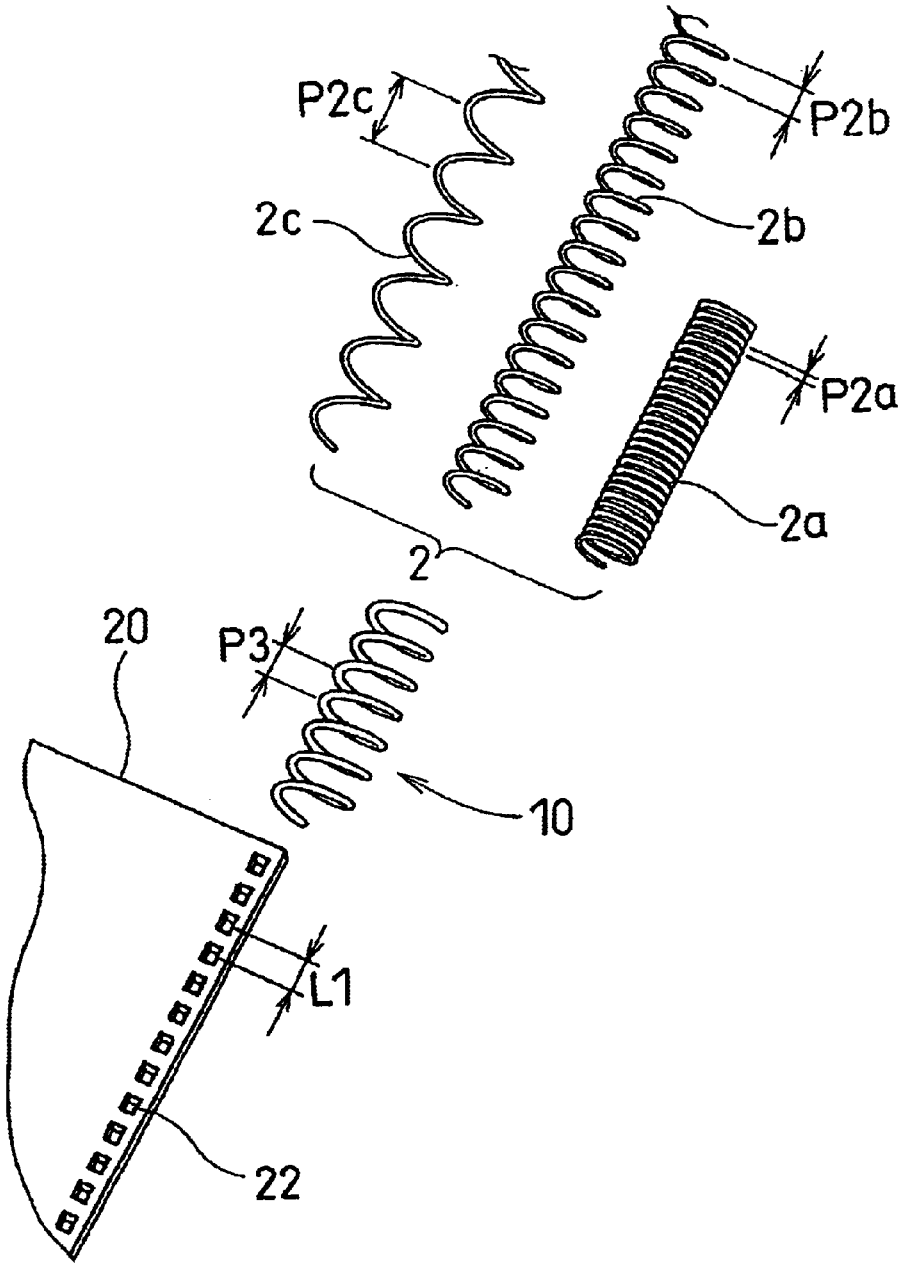
FIG. 1 is a perspective view showing a setup state before starting bookbinding operation using a variable-pitch spiral coil according to a preferred embodiment of the present invention.

FIG. 1 is an enlarged perspective view of a preferred embodiment of the present invention. The sheets 20 have a series of the holes 22 for bookbinding punched at one side. The method in itself for punching the holes 22 is not a matter of concern for the present invention. The plurality of sheets 20 is bound to one book with a spiral coil 2, which is indicated by reference numerals 2*a*, 2*b*, and 2*c*, inserted through the series of holes 22. In this case, the spiral coil 2 is different from the spiral coil 1, in which the pitch P2 (see reference numerals P2*a*, P2*b*, and P2*c*) is different from the spacing L1 between the series of holes 22 punched in the sheets 22. More specifically, the spiral coil 2 is formed of a metallic material, such as an iron. Preferably, the spiral coil 2 is densely wound as compared with the spiral coil 1 so that it is compact and convenient for carrying on. However, there is no need for the spiral coil 2 necessarily to be formed in a densely spiraled coil and may be wound at a different pitch.

As mentioned above, the preferred embodiment according to the present invention uses a spiral coil 2 wound at a variable pitch in an unused state. The variable pitch can be described by roughly classifying it into three forms with reference to FIG. 1.

(1) For example, the spiral coil may be densely wound as indicated by the reference numeral 2*a*. In this case, the pitch P2*a* is as small as the diameter of the coil.

(2) Alternatively, as indicated by the reference numeral 2*b*, the spiral coil may have a different pitch from the sheet 20. For example, when the spacing L1 between the series of holes 22 punched in the sheet 20 is 6-mm in pitch, a spiral coil with pitch P2*b* of 5 mm may be used. In other words, although the spiral coil 2*b* is wound with an appropriate pitch according to the relevant art, the pitch is different from the centerline spacing L1 between the holes of the sheets 20.

(3) As indicated by the reference numeral 2*c*, the spiral coil may be wound at a larger pitch. This is not for the purpose of bookbinding but for bookbinding using a similar spiral coil used in other fields. In other words, the spiral coil 2*c* is a product in different field from the instant application and also the pitch P2*c* is different from the centerline spacing L1 between the holes in the sheets 20.

As described above, the present invention performs bookbinding operation using the spiral coil 2 wound at the pitch P2 at least different from the spacing L1 between the series of holes 22 punched in the sheets 20. In order to avoid duplicate description, the spiral coil 2 in the following description and drawings indicates the spiral coil 2*a* densely wound at a variable pitch. In this case, however, the spiral coil 2 shall always include the coils denoted by the reference numerals 2*a*, 2*b*, and 2*c*. The embodiment of the present invention separately prepares a bookbinding device 10 to smoothly insert the spiral coil 2 into the holes 22 of the sheets 20, as shown in FIG. 1.

Unlike the spiral coil 2, the bookbinding device 10 has a pitch P3 equal to the spacing L1 between the holes 22 punched in the sheets 20. Also, the bookbinding device 10 is rigid enough to hold the pitch unchanged such that a constant pitch is always maintained during spiral feeding. One major feature is that the bookbinding device 10 has a constant pitch, a constant radius, and a constant wire diameter, advances spirally at least several times. Furthermore, the bookbinding device 10 has an engaging portion 14 (see FIG. 3) at the end for engagement with an end of the spiral coil 2. Preferably, the bookbinding device 10 is wound spirally several times, but the number of windings may be varied as appropriate depending on practical applications (see FIG. 1). However, experiment has shown that a too large or small number of windings may pose functional problems. Furthermore, by forming the radius R3 of the bookbinding device 10 larger than the radius R2 of the spiral coil 2, it becomes easy for users to hold by hand, thus improving operability (see FIG. 4). Also, there is provided a force for engagement with the spiral coil 2, at the end, which will be described later. More specifically, the bookbinding device 10 is formed of a metallic material including aluminium and brass or a plastic material. Using the bookbinding device 10 enables the spiral coil 2 to be reliably inserted through the series of holes 22 punched in the sheets 20.

Figure 3:
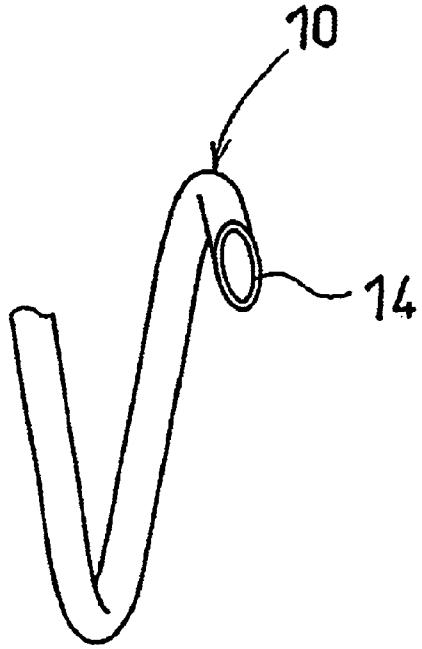
FIG. 3 is an enlarged perspective view of an end of a bookbinding device according to a preferred embodiment of the present invention.
Figure 4:
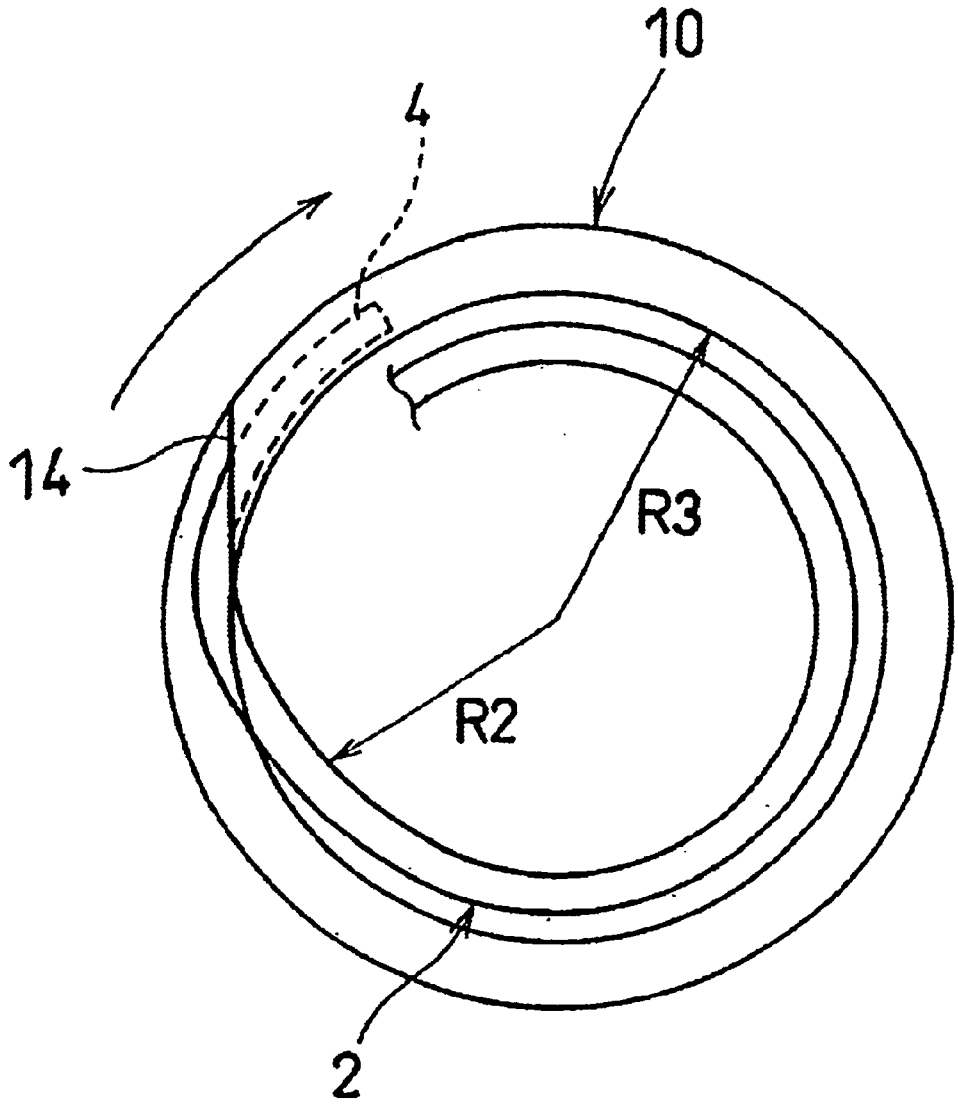
FIG. 4 is an enlarged front view showing engagement between the ends of the variable-pitch spiral coil and the bookbinding device.

As stated above, the bookbinding device 10 has the engaging portion 14 formed at least at the end thereof for coupling with the spiral coil 2. More specifically, as shown in FIGS. 3 and 4, the engaging portion 14 is provided by forming a cavity at the end of the bookbinding device 10 such that the cavity ensures engagement with an end 4 of the spiral coil 2. The engagement is preferably established by friction developed due to the fact that the radius R3 of the bookbinding device 10 and the radius R2 of the spiral coil 2 differ from each other (see FIG. 4). As can be guessed from FIG. 3, the engagement portion 14 is opened in the radial direction with respect to an axis, along which the bookbinding device 10 is spirally fed, for allowing the end of the bookbinding device 10 to be easily brought into engagement with the end 4 of the spiral coil 2. With the engaging portion 14 opened in the radial direction, the end 4 of the spiral coil 2 can be smoothly inserted into the engaging portion 14 of the bookbinding device 10 (see FIG. 4). FIG. 4 shows a state immediately after inserting the spiral coil 2 into the bookbinding device 10. From the standpoint of reliable operation, the spiral coil 2 is preferably inserted into the bookbinding device 10 up to a deeper portion. While the engaging portion 14 is opened outward in FIG. 4 for making the engaging portion 14 opened in the radial direction with respect to the axis, along which the bookbinding device 10 is spirally fed, it may be opened inward reversely.

Thus, since the end of the bookbinding device 10 and the end of the spiral coil 2 differ in shape, the end of the spiral coil 2 can be engaged with the engaging portion 14 of the bookbinding device 10 by frictional engagement within the elastic limit. In one practical example, as described above, the difference in shape between the end of the spiral coil 2 and the engaging portion 14 of the bookbinding device 10 is provided as a difference in radius and pitch therebetween (see FIG. 4).

Figure 2:
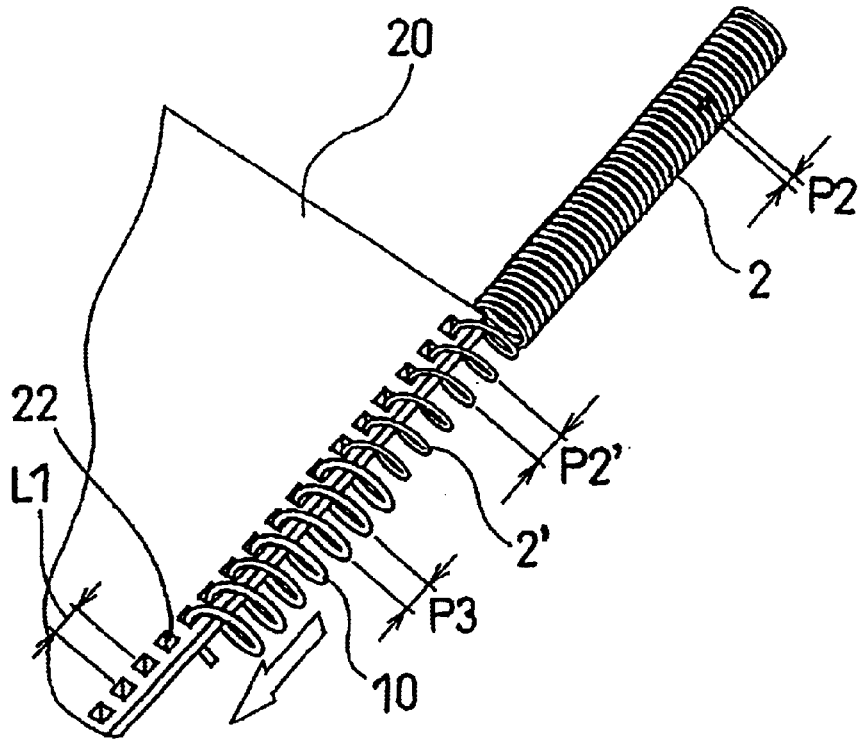
FIG. 2 is a perspective view showing a state during bookbinding operation using a variable-pitch spiral coil according to a preferred embodiment of the present invention.

After engaging the end 4 and the engaging portion 14 to couple the bookbinding device 10 with the spiral coil 2, the bookbinding device 10 is inserted through the holes 22 in the sheets 20. That insertion is performed by driving the bookbinding device 10 to spirally advance in a usual manner. FIG. 2 is a perspective view showing a state in which the bookbinding device 10 is spirally fed a certain distance through the holes 22 in the sheets 20. As shown in FIG. 2, the bookbinding device 10 is inserted through the holes 22 while the spiral coil 2 follows the bookbinding device 10, thereby binding the plurality of sheets 20 together. More specifically, by spirally feeding the bookbinding device 10, the spiral coil 2 is inserted through the holes 22 in the sheets 20 such that the pitch P2 of the spiral coil 2 is changed to a pitch P2' substantially equal to the pitch P3 of the bookbinding device 10 (see reference numeral 2' in FIG. 2). More specifically, the spiral coil 2 is subjected to plastic deformation to change the pitch from P2 to P2'. The plastic-deformed spiral coil 2 is held unchanged at the pitch P2' after deformation.

Since the pitch P2' is changed so as to substantially equal to the centerline spacing L1 between the holes 22, the spiral coil 2 can be inserted through the holes 22 in the sheets 20. Thus, although it has been practically impossible to quickly insert the variable-pitch spiral coil 2 through the holes 22 in the sheets 20 by manually driving it without using aids, this embodiment enables the spiral coil 2 to be continuously inserted through the holes 22 in the sheets 20 in a simple and effective manner using the bookbinding device 10. Consequently, simple and effective bookbinding operation can be performed using the densely spiraled coil, which is easy to store, or the spiral coil wound at a different pitch.

More specifically, the spiral coil 2 is configured by a metallic wire that can be plastically deformed and a soft coating material for coating the metallic wire. The plastic deformation of the metallic spiral coil allows bookbinding operation using the various-pitch spiral coil. Also, the soft coating material may be decollated with patterns or colors to meet requirements of industrial design. However, the spiral coil may not be coated and may be formed of other materials.

Figure 5:
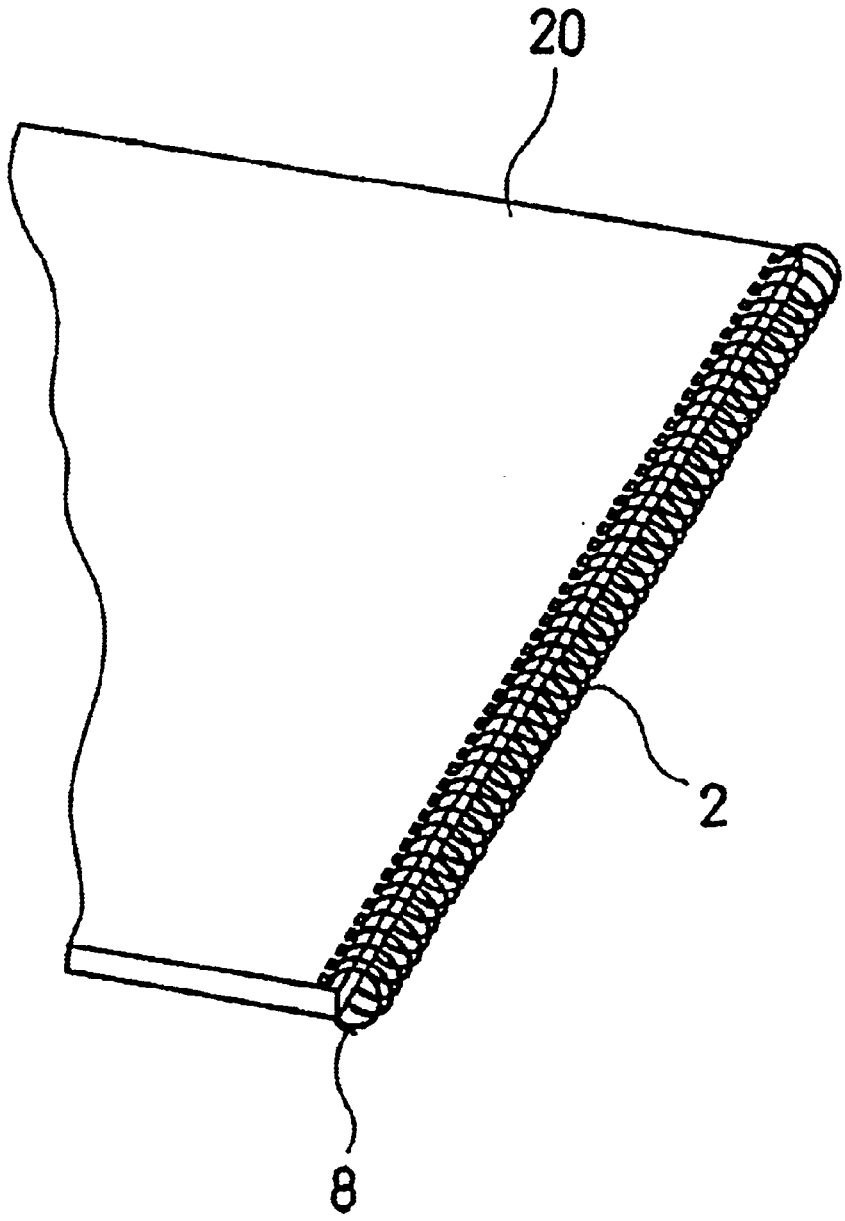
FIG. 5 is a perspective view of an assembly structure of a simplified bookbinding device after operation using the variable-pitch spiral coil.
Figure 6:
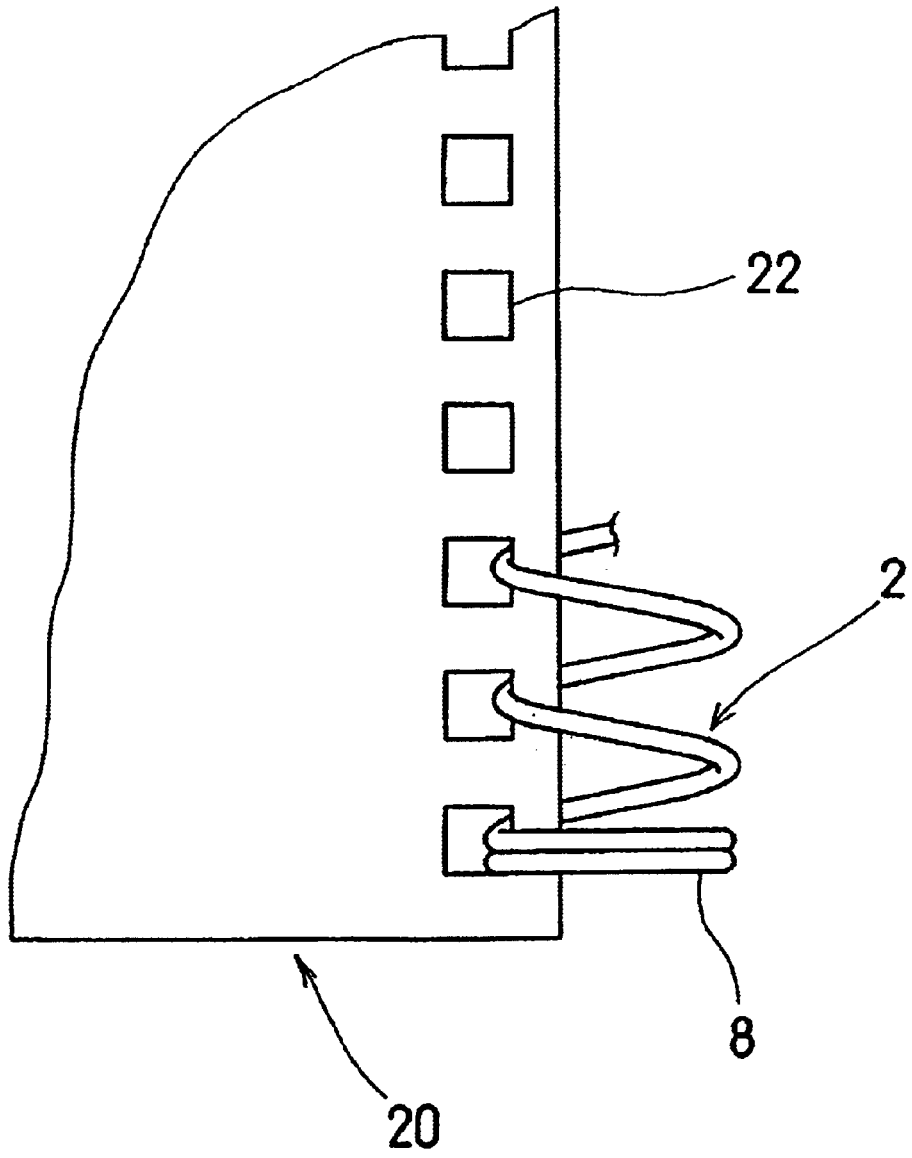
FIG. 6 is an enlarged front view showing terminal treatment using a spiral coil that is subjected to plastic deformation.

FIG. 5 is a perspective view showing a state in which the plurality of sheets 20 is bound together by inserting the spiral coil 2 through all of the holes 22 in the sheets 20. Furthermore, as terminal treatment at the opposite ends of the sheets 20 performed with the spiral coil 2, the spiral coil 2 is coiled several times through the end hole 22 in the sheets 20 (see reference numeral 8 in FIGS. 5 and 6). When the spiral coil 2 is too long and left unused after binding the sheets 20 together, it can be cut as appropriate at the end thereof. FIG. 6 is an enlarged front view showing the terminal treatment according to the present invention. As can be seen in the drawing, preferably, the binding operation is completed by winding the spiral coil 2 several times through each end hole.

As well known, conventional-art terminal treatment in the relevant field has been performed by bending each end of a metallic or plastic spiral coil. In that case, as a matter of course, the spiral coil is difficult to reuse. In the present invention, the spiral coil 2 can easily be wound several times through each end hole 22 (see reference numeral 8 in FIG. 6) in the sheets 20. Thus the reuse of the coil can be ensured.

Furthermore, in the embodiment according to the present invention, the spiral coil 2 is held in the shape after plastic deformation so as to function well after binding operation. That is, the present invention has an advantage of not catching the bound sheets 20 in the spiral coil 2 at the end 8. This also enables a small number of sheets to be bound into one book.

According to the first aspect of the present invention, as described above, a plurality of sheets can be bound by the plastic deformation of the spiral coil irrespective of the difference between the spacing between the holes punched in the sheets and the pitch of the spiral coil.

According to the present invention, in addition to the above benefits, a plurality of sheets can be bound using a spiral coil wound at a variable pitch, such as a densely spiraled coil having high portability, a spiral coil wound at a different pitch, and a spiral coil used for different fields.

According to the second aspect of the present invention, by using the spiral coil according to the first aspect of the present invention, there can be provided a bookbinding device for binding a plurality of sheets by inserting a compact and easy-to-use spiral coil without the need for a large dedicated bookbinding device or a special work.

According to the present invention, in addition to the above benefits, the spiral coil and the bookbinding device can easily be brought into engagement with each other only on the basis of the outer shapes without the need for special operation.

According to the third aspect of the present invention, by using the bookbinding device according to the second aspect of the present invention, there can be provided a bookbinding method for binding a plurality of sheets into one book by inserting the spiral coil therethrough with an exceedingly simplified device without the need for a well-known electric or large bookbinding device.

What is claimed is:

1. A spiral coil used when stacking a plurality of sheets each having a plurality of holes punched at a constant pitch, and binding the plurality of sheets together by inserting the spiral coil through each of the holes, wherein the spiral coil is plastically deformed to have a different pitch from that between the holes in an unused state, and to have the same pitch as that between the holes during use.

2. A spiral coil according to claim 1, wherein the spiral coil is wound at a variable pitch in an unused state.

3. A bookbinding device used when stacking a plurality of sheets each having a plurality of holes punched at a constant pitch, and binding the plurality of sheets together by inserting the spiral coil according to claim 1 through each hole, wherein the bookbinding device has a spiral shape wound at the same pitch as that between the plurality of holes and has an engaging portion formed at at least one end thereof for engaging with an end of the spiral coil.

4. A bookbinding device according to claim 3, wherein the engaging portion has a shape different from the end of the spiral coil, and the end of the spiral coil is inserted into the engaging portion for engaging with each other.

5. A bookbinding device used when stacking a plurality of sheets each having a plurality of holes punched at a constant pitch, and binding the plurality of sheets together by inserting the spiral coil according to claim 2 through each hole, wherein the bookbinding device has a spiral shape wound at the same pitch as that between the plurality of holes and has an engaging portion formed at at least one end thereof for engaging with an end of the spiral coil.

6. A bookbinding method, wherein a plurality of sheets each having a plurality of holes punched at a constant pitch is stacked and bound into one book using a spiral coil and a bookbinding device, wherein the spiral coil is plastically deformed to have different pitch from that between the holes in an unused state, and to have the same pitch as that between the holes during use, and the bookbinding device has a spiral shape wound at the same pitch as that between the plurality of holes and has an engaging portion formed at at least one end thereof for engaging with an end of the spiral coil.

* * * * *